US005613883A

United States Patent [19]

Chadbourne et al.

[11] Patent Number: 5,613,883

[45] **Date of Patent: *Mar. 25, 1997**

[54] WEDGE CONNECTOR FOR ELECTRICAL CONDUCTORS

[75] Inventors: Richard Chadbourne, Merrimack; William J. Lasko, Lisbon, both of N.H.; José C. Fatorusso, Santo Amaro, Brazil; Amauri Barbosa, Vila Caldas, Brazil; Sergio R. Grillo, Santo Amaro, Brazil

[73] Assignee: Framatome Connectors USA Inc., Norwalk, Conn.

[ * ] Notice: The term of this patent shall not extend beyond the expiration date of Pat. No. 5,507,671.

[21] Appl. No.: 573,389

[22] Filed: Dec. 15, 1995

Related U.S. Application Data

[63] Continuation-in-part of Ser. No. 306,463, Sep. 15, 1994, Pat. No. 5,507,671.

[51] Int. Cl.[6] ..... H01R 4/50

[52] U.S. Cl. ..... 439/783; 24/136 R

[58] Field of Search ..... 439/783, 863; 24/136 R, 115 M

[56] References Cited

U.S. PATENT DOCUMENTS

| | | | |
|---|---|---|---|
| 2,106,724 | 2/1938 | Cope | 173/273 |
| 2,814,025 | 11/1957 | Wade et al. | 339/256 |
| 2,828,147 | 3/1958 | Peiffer | 285/138 |
| 3,065,449 | 11/1962 | Matthysse et al. | 339/247 |
| 3,275,974 | 9/1966 | Mixon, Jr. | 339/243 |
| 3,329,928 | 7/1967 | Broske | 339/247 |
| 3,349,167 | 10/1967 | Mixon, Jr. et al. | 174/94 |
| 3,462,543 | 8/1969 | Wahl et al. | 174/94 |
| 3,504,332 | 3/1970 | Mixon, Jr. | 339/273 |
| 3,516,050 | 6/1970 | Mixon, Jr. et al. | 339/247 |
| 3,588,791 | 6/1971 | Polidori | 339/247 |
| 3,920,310 | 11/1975 | Walsh et al. | 339/256 SP |
| 4,059,333 | 11/1977 | Mixon, Jr. | 339/247 |
| 4,533,205 | 8/1985 | Frank | 339/247 |
| 4,600,264 | 7/1986 | Counsel | 339/247 |
| 4,634,205 | 1/1987 | Gemra | 339/97 R |
| 4,650,273 | 3/1987 | Roosdrop | 339/247 |
| 4,723,920 | 2/1988 | Werner | 439/782 |
| 4,723,921 | 2/1988 | Pooley | 439/783 |
| 4,730,087 | 3/1988 | Werner | 174/94 S |
| 4,734,062 | 3/1988 | Goto | 439/783 |
| 4,813,894 | 3/1989 | Mixon, Jr. | 439/783 |
| 4,863,403 | 9/1989 | Shannon | 439/783 |
| 4,872,856 | 10/1989 | Pooley et al. | 439/783 |
| 4,915,653 | 4/1990 | Mair | 439/781 |
| 5,006,081 | 4/1991 | Counsel et al. | 439/783 |
| 5,044,996 | 9/1991 | Goto | 439/783 |
| 5,145,420 | 9/1992 | Counsel et al. | 439/783 |
| 5,244,422 | 9/1993 | Laricchia | 439/783 |
| 5,349,336 | 8/1994 | Menechella | 439/863 |

OTHER PUBLICATIONS

"Ampact Grounding System", AMP Corporation, Mar. 1988, pp. 1–16.

*Primary Examiner*—Gary F. Paumen
*Attorney, Agent, or Firm*—Perman & Green

[57] ABSTRACT

An electrical connector for connecting electrical conductors. The connector has a "C" shaped sleeve and a wedge. The sleeve has a middle section with an interior surface having a longitudinal depression, a main stop ledge at a rear end of the depression and a temporary stop ledge at the rear of the sleeve. The wedge is comprised of an elongate sheet metal member that is folded over along its length at least two times to form the wedge with two adjacent loops. A side edge of the sheet metal member forms multiple latching ledges to engage stop ledges on the sleeve for preventing the wedge from moving out of the sleeve.

15 Claims, 2 Drawing Sheets

WEDGE CONNECTOR FOR ELECTRICAL CONDUCTORS

CROSS REFERENCE TO RELATED APPLICATION

This is a continuation-in-part application of U.S. application Ser. No. 08/306,463 filed Sep. 15, 1994, now U.S. Pat. No. 5,507,671 issued Apr. 16, 1996.

BACKGROUND OF THE INVENTION

1. Field of the Invention

The present invention relates to electrical connectors and, more particularly, to a wedge connector.

2. Prior Art

U.S. Pat. No. 4,650,273 discloses an electrical connector with a general "C" shaped sleeve and a wedge. The wedge is stamped and formed from sheet metal and has a tab at its front end. The tab engages a front end of the sleeve to resist withdrawal of the wedge from the sleeve. U.S. Pat. No. 5,006,081 discloses a wedge connector with a "C" shaped sleeve having a hole in its middle section for engaging a dimple on a stamped and formed sheet metal wedge. Other U.S. Patents that relate to wedge connectors include the following:

U.S. Pat. Nos. 2,106,724; 2,814,025; 2,828,147; 3,065,449; 3,275,974; 3,329,928; 3,349,167; 3,462,543; 3,504,332; 3,516,050; 3,588,791; 3,920,310; 4,059,333; 4,533,205; 4,600,264; 4,634,205; 4,723,920; 4,723,921; 4,730,087; 4,734,062; 4,813,894; 4,863,403; 4,872,856; 4,915,653; 5,044,996; 5,145,420; 5,244,422.

SUMMARY OF THE INVENTION

In accordance with one embodiment of the present invention an electrical connector is provided for connecting electrical conductors. The connector comprises a connector sleeve and a wedge. The sleeve has a general "C" shape. The wedge is adapted to be located inside the sleeve and comprises a sheet metal member having an elongate length that is folded over itself lengthwise to form the wedge. The wedge has multiple latching ledges on a lateral side of the wedge formed by a side edge of the sheet metal member.

In accordance with another embodiment of the present invention an electrical connector is provided for connecting electrical conductors together. The connector comprises a one piece connector sleeve and a wedge. The connector sleeve has a general "C" shape formed by two opposing channel sections interconnected by a middle section. The middle section has a stop ledge and a longitudinal depression along an interior side of the middle section. The wedge is suitably sized and shaped to be inserted in the sleeve. The wedge has multiple latching ledges on a lateral side of the wedge for engaging the stop ledge to prevent the wedge from being removed from the sleeve.

In accordance with another embodiment of the present invention in an electrical connector having a sleeve and a wedge for use in connecting electrical conductors together, the wedge being comprised of a single sheet metal member that has been deformed into the wedge shape, the improvement comprises the sheet metal member having an elongate length which is folded over itself at least two times along its length to form the length of the wedge and multiple latching ledges on a lateral side.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
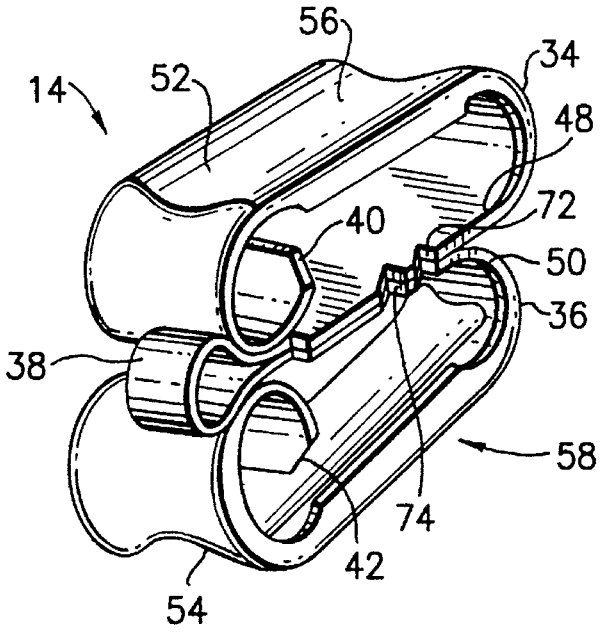
FIG. 1 is a perspective view of a wedge of an electrical wedge connector incorporating features of the present invention.
Figure 2:
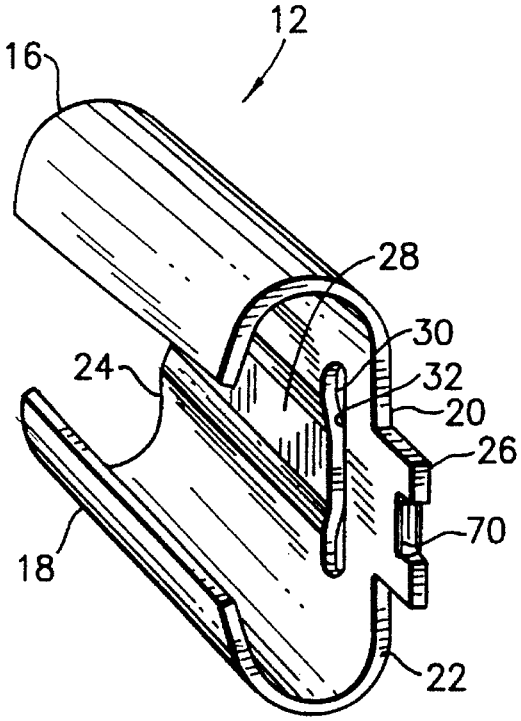
FIG. 2 is a perspective view of a sleeve of an electrical wedge connector for use with the wedge shown in FIG. 1.
Figure 3:
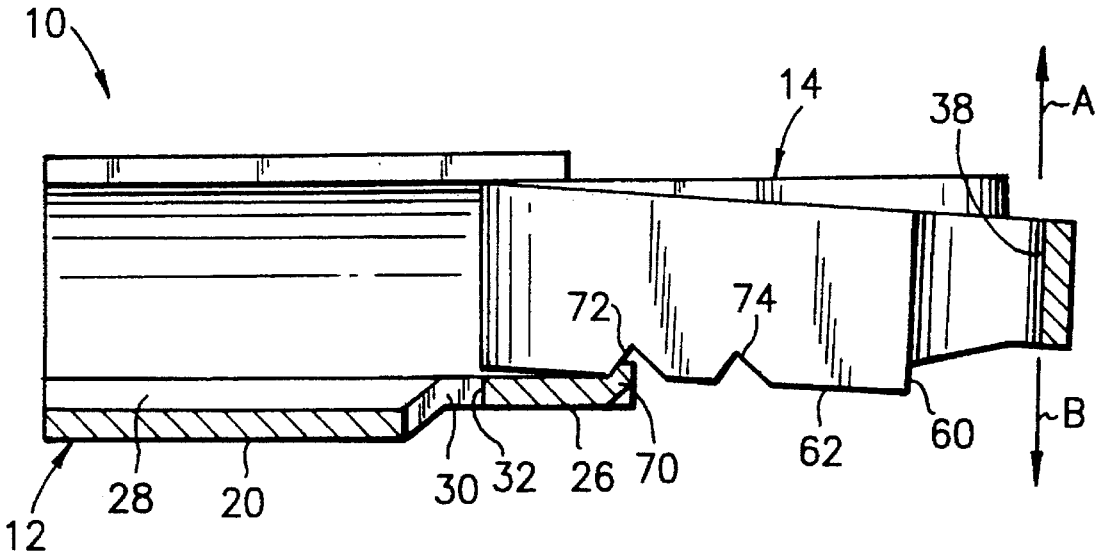
FIG. 3 is a cross-sectional view of the wedge and sleeve shown in FIGS. 1 and 2 at a partially assembled position.

Referring to FIGS. 1–3, there is shown a wedge 14 and sleeve 12 incorporating features of the present invention. The wedge 14 and sleeve 12 form a wedge connector 10 (see FIG. 3) for connecting two electrical conductors (not shown) together. Although the present invention will be described with reference to the single embodiment shown in the drawings, it should be understood that the present invention can be embodied in many alternate embodiments. In addition, any suitable size, shape or type of elements or materials could be used.

The sleeve 12 is preferably made of sheet metal, but it could also be a cast, drawn, or extruded member. The sleeve 12 has two opposing channel sections 16, 18 interconnected by a middle section 20 to form a general "C" shape. The "C" shape tapers from the rear end 22 to the front end 24. The middle section 20 includes a rear end tab 26, a groove or depression 28, and a slot 30. The slot 30 is located proximate the rear end of the sleeve and forms a stop ledge 32. The slot 30 extends entirely through the middle section 20 from the interior surface to the exterior surface. However, in an alternate embodiment that slot 30 need not extend entirely through the middle section 20. The depression 28 extends from the slot 30 to the front end 24 of the sleeve. In another alternate embodiment, the depression 28 need not extend to the front end 24, but the slot 30 should be located at the rear end of the depression 28.

The wedge 14 is comprised of a single elongate sheet metal member that has been deformed into the shape shown. The sheet metal member has been folded over itself in a lengthwise direction several times along its length to form the wedge 14. In alternate embodiments, more or less folds could be provided. In the embodiment shown, the sheet metal member is folded over itself around axes at the front and rear of the wedge 14. The axes are generally perpendicular to the axis of intended insertion of the wedge 14 into the sleeve 12. The wedge 14 has two adjacent main loop sections 34, 36 interconnected by a third loop section 38. The two longitudinal ends 40, 42 of the sheet metal member are located in the two main loops 34, 36, respectively. The third loop 38, in addition to interconnecting the first and second main loops 34, 36 also functions as a back support or containment support for the main loops 34, 36. Because of the curved nature of the third loop 38, when the wedge is compressed, the ends 40, 42 can be rotated towards the inside surfaces of the main loops 34, 36. If the compressive force is sufficient enough, the ends 40, 42 can contact the inside surfaces of the main loops 34, 36 to add rigidity to the main loops. The backsides 48, 50 of the main loops 34, 36 are located adjacent each other. The exterior sides 52, 54 of the main loops 34, 36 have grooves 56, 58 for locating the conductors in. In the embodiment shown, the depth of the groove 56 in the first main loop 34 is greater than the depth of the groove 58 in the second main loop 36 for accommodating a larger conductor. However, any type of suitable shapes could be provided on the exterior sides 52, 54.

One of the lateral sides of the wedge 14 has a full insertion latching ledge 60. More specifically, the lateral side 62 of the backsides 48, 50 progressively extend in a lateral direction from the front to the rear which then form the ledge 60 just before the third loop 38. The side 62, thus, forms a ramp in front of the latching ledge 60. The latching ledge 60 is adapted to be located in the slot 30 of the connector sleeve 12 to prevent the wedge 14 from being inadvertently disengaged from the sleeve 12. The ramp formed by the lateral side 62 of the backsides 48, 50 is provided to ease insertion of the wedge 14 into the sleeve 12 over the section of the sleeve rear of the stop ledge 32. The interior longitudinal depression 28 on the middle section 20 of the sleeve 12 is provided in front of slot 30 to accommodate the lateral side ramp of the wedge 14. When the connector 10 connects the two conductors the latching ledge 60 is located in the slot 30 such that the stop ledge 32 can engage the latching ledge 60 to prevent unintentional removal of the wedge 14 from inside the sleeve 12. However, the slot 30 nonetheless allows a user access to the side 62 if it is desired to intentionally remove the wedge 14 from the sleeve 12.

In addition to the full insertion latching provided by the ledges 32 and 60, the connector 10 also has a temporary intermediate latching system. More specifically, the sleeve 12 has an inwardly protruding bump or tab 70 at the rear end tab 26, and the wedge 14 has cutouts 72, 74 in the backsides 48, 50 at the lateral side 62. The cutouts 72, 74 are located in front of the full insertion ledge 60. With this system the wedge 14 can be partially inserted into the sleeve 12 and latched together. During insertion of the wedge 14 into the sleeve 12 the backsides 48, 50 are cammed in direction A until the first cutout 72 comes into registry with the inwardly protruding tab 70. The backsides 48, 50 then snap back in direction B to temporarily latch the wedge and sleeve together. This allows the conductors, wedge, and sleeve to the properly positioned relative to each other and form an assembly that is held together while a tool (not shown) for fully inserting the wedge into the sleeve is attached to the assembly. If the conductors are small, the user can move the lateral side 62 in direction A to disengage the inwardly protruding tab 70 from the first cutout 72. The wedge 14 would then be moved forward in the sleeve 12 and the third loop 38 released with the inwardly projecting tab 70 being received in the second cutout 74. Thus, the wedge 14 can be received at either of the two intermediate positions. Each cutout 72, 74 has a general "V" shape. The front side of the "V" shape forms a ledge for interacting with the front of the inwardly projecting bump or tab 70 to prevent the wedge 14 from coming out of the sleeve 12. The rear side of the "V" shape and the sloped rear of the tab 70 form camming surfaces to cam the lateral side in direction A when the tool (not shown) propels the wedge 14 into its fully inserted position. The backsides 48, 50 snap back in direction B when the full insertion ledge 60 passes the inwardly projecting tab 70. The fully inserted position is when the ledge 60 engages with the ledge 32.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector for connecting electrical conductors together, the connector comprising:

a connector sleeve having a general "C" shape; and a wedge adapted to be located inside the sleeve, the wedge comprising a sheet metal member having an elongate length that is folded over itself around an axis perpendicular to an axis of insertion of the wedge into the sleeve to thereby form the wedge, the wedge having multiple latching ledges on a lateral side of the wedge formed by a side edge of the sheet metal member.

2. A connector as in claim 1 wherein the sleeve has a depression along an interior side of a middle section of the sleeve.

3. A connector as in claim 2 wherein the sleeve has a slot through the middle section at a rear end of the depression that forms a stop ledge for engaging the latching ledge.

4. A connector as in claim 1 wherein the sleeve has a stop ledge on an interior side of a middle section of the sleeve.

5. A connector as in claim 1 wherein the wedge has at least two adjacent loop sections, each of the loop sections having a surface for contacting the conductors and wedging the conductors against the sleeve.

6. A connector as in claim 1 wherein longitudinal ends of the sheet metal member are located in an interior area of the wedge and are suitably located to push against other portions of the sheet metal member when the wedge is compressed.

7. An electrical connector for connecting electrical conductors together, the connector comprising:

a one-piece connector sleeve having a general "C" shape formed by two opposing channel sections interconnected by a middle section, the middle section having a stop ledge and a depression along an interior side of the middle section; and a wedge suitably sized and shaped to be inserted into the sleeve, the wedge having multiple latching ledges on a lateral side edge of the wedge for engaging the stop ledge to prevent the wedge from being removed from the sleeve.

8. A connector as in claim 7 wherein the wedge is comprised of a single elongate sheet metal member that is bent at locations along its length to form the length of the wedge.

9. A connector as in claim 8 wherein the sheet metal member is formed with multiple loops.

10. A connector as in claim 8 wherein a lateral side edge of the sheet metal member forms the latching ledges on the lateral side of the wedge.

11. In an electrical connector having a sleeve and a wedge for use in connecting electrical conductors together, the wedge being comprised of a single sheet metal member that has been deformed into the wedge, the improvement comprising:

the sheet metal member having an elongate length which is folded over itself at least two times along its length to form the length of the wedge, the sheet metal member being folded around axes perpendicular to an axis of insertion of the wedge into the sleeve, wherein the sheet metal member has multiple latching ledges on a lateral side thereof.

12. A connector as in claim 11 wherein the wedge has first and second adjacent loop sections, each section having a surface for contacting one of the conductors.

13. A connector as in claim 11 wherein a side edge of the sheet metal member forms the latching ledges on a lateral side of the wedge.

14. A connector as in claim 11 wherein longitudinal ends of the sheet metal member are located in an interior area of the wedge and are adapted to push against portions of the sheet metal member when the wedge is compressed.

15. A connector as in claim 12 wherein the two loops are connected by a third loop and longitudinal ends of the sheet metal member are located in the first and second adjacent loops.

* * * * *